US005926865A

United States Patent [19]

Witinski et al.

[11] Patent Number: 5,926,865

[45] Date of Patent: Jul. 27, 1999

[54] COVER FOR TURBO JET DISPENSING HEAD EMPLOYED IN SWIMING POOL FILTERING SYSTEM

[76] Inventors: Joseph L. Witinski, 626 W. Farmdale Ave., Mesa, Ariz. 85210; Stephen D. Allen, 1823 W. Springfield Way, Chandler, Ariz. 85248

[21] Appl. No.: 08/935,559

[22] Filed: Sep. 23, 1997

[51] Int. Cl.[6] ..... E04H 4/00

[52] U.S. Cl. ..... 4/496; 4/492

[58] Field of Search ..... 4/490, 496, 492, 4/661, 286, 288; 210/162, 166, 497.3

[56] References Cited

U.S. PATENT DOCUMENTS 4,658,449 4/1987 Martin ..... 4/496

4,896,384 1/1990 Dijkhuizen ..... 4/490

4,941,217 7/1990 Tobias et al. ..... 4/492

*Primary Examiner*—David J. Walczak

*Attorney, Agent, or Firm*—Warren F. B. Lindsley

[57] ABSTRACT

A cover for the dispensing head of a turbo jet swimming pool cleaning device comprising a plurality of integral radially extending fingers uniformly spaced about the periphery of a circular top, the fingers serving as extensions of vanes incorporated in said dispensing head and also as ramps enabling other swimming pool cleaning equipment to pass without difficulty over the dispensing head.

5 Claims, 3 Drawing Sheets

COVER FOR TURBO JET DISPENSING HEAD EMPLOYED IN SWIMING POOL FILTERING SYSTEM

BACKGROUND OF THE INVENTION

A common method for cleaning swimming pools involves the use of water jets to stir up sediment on the pool surfaces. The suspended particles are then circulated through a filter for removal. One such cleaning system utilizes a device that is known as a turbo jet. Return water from the filter is ejected by this device as a concentrated, highly directional jet of water that rotates about the dispensing head stirring up sediment from the surrounding pool surface.

While this device has proven effective in serving its intended purpose, it does present a problem of some significance. The problem is that the dispensing head of the turbo jet comprises an obstacle that interferes with other cleaning devices that are frequently employed in the same pool. This problem arises because the dispensing head protrudes perpendicularly from the pool surface. Other cleaning devices that travel over the pool surfaces tend to collide with the projecting dispensing head and then become stalled in position. Hoses, whips and various other cleaning system elements may also be caught or undesirably diverted by the dispensing head.

The present invention provides means for correcting the problem in new dispensing head designs as well as in existing turbo jet equipment.

DESCRIPTION OF THE PRIOR ART

While the turbo jet device is known in the prior art, means for correcting the problems associated with the device are not as yet provided in the prior art.

SUMMARY OF THE INVENTION

In accordance with the invention claimed, means are provided for correcting the problems described earlier wherein the turbo jet dispensing head is found to act as an obstacle that interferes with the proper operation of other cleaning system equipment. For new designs of the dispensing head, the means comprises a modification of the external contours of the dispensing head; for the correction of the problem in existing turbo jet installations the means comprises a cover that is readily installed over the existing turbo jet dispensing head.

It is, therefore, one object of this invention to define a modified external contour for a turbo jet dispensing head which avoids acting as an obstacle that traps other cleaning system equipment or interferes with the effective operation thereof.

Another object of this invention is to provide a cap or cover for existing turbojet dispensing heads as a means for reducing the tendency to trap or interfere with other cleaning system equipment.

A further object of this invention is to provide such a cap or cover in a form that will not interfere with or significantly degrade the performance of the dispensing head itself.

A still further object of the present invention is to provide such a cap or cover in a form which is easily installed and secured in place over the prior art dispensing head in a very short time.

A still further object of this invention is to provide such a cap or cover for a turbo jet dispensing head in a very simple and inexpensive form.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
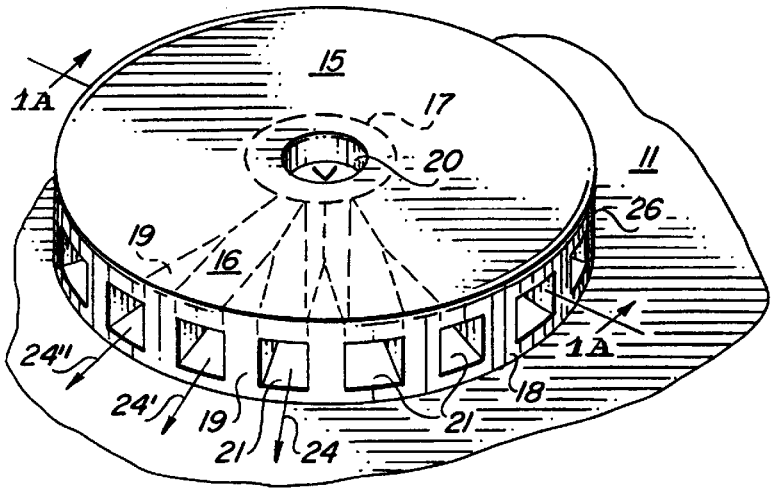
FIG. 1 (PRIOR ART)
FIG. 1 is a perspective view of a prior art turbo jet dispensing head installed in a swimming pool.
Figure 1A:
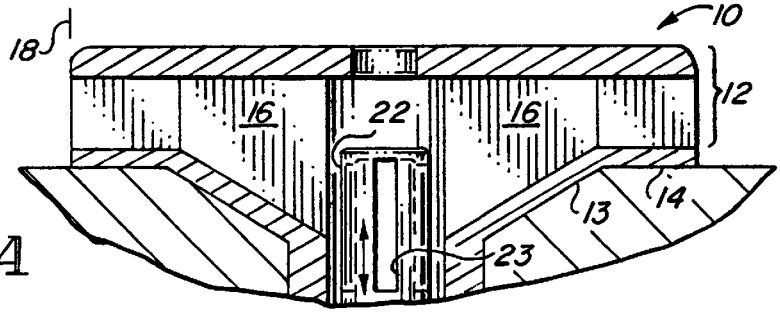
FIG. 1A (PRIOR ART)
FIG. 1A is a cross-sectional view of FIG. 1 taken along line 1A—1A of FIG. 1.

Referring more particularly to the drawings by characters of reference, FIGS. 1 and 1A show the prior art dispensing head of a turbo jet swimming pool cleaning device. The turbo jet dispensing head 10 has the form of a thick disc or low cylinder that projects perpendicularly from the surface 11 of the pool bottom or wall.

The dispensing head 10 comprises a finned crown 12, the main portion of which protrudes from the surface 11 of the pool wall, and a valve portion 13 which fits inside an opening in the wall of the pool except for a flange 14 that rests upon the wall surface 11 surrounding the opening.

The molded plastic crown 12 is typically about five and one half inches in diameter and ⅝ inches thick. The combined thickness or height (in the case of a pool floor installation) of the crown and the flange 14 is approximately ¾ inches—sufficient to comprise an obstacle for other pool cleaning devices, hoses, whips, etc.

The geometry of the crown 12 as shown in FIGS. 1 and 1A comprises a flat circular upper disc 15 (again assuming an upright installation in the pool floor) and integral fins 16 that extend radially outwardly from a centered circular opening 17 to the perimeter 18 of the crown 12. The fins 16, some of which are shown by broken lines in FIG. 1 have wedge shaped outer portions 19. The fins are uniformly spaced about the circumference of the crown 12, serving as the walls of a plurality of channels 21 that extend radially outwardly from the centered circular opening 17 to the circumferential perimeter 18. An observation hole 20 in the center of upper disc or wall 15 is useful as a means for checking the operation of the turbo jet.

The valve portion 13 includes a cylindrical pop-up valve 22 with a slotted longitudinal opening 23 on one side. The valve 22 is controlled by water pressure and a ratcheting mechanism (not shown) that cause the valve 22 to move into the circular opening 17 from which the fins 16 extend. The ratcheting mechanism causes the valve 22 to rotate progressively in steps causing the slotted opening 23 to move from alignment with one channel 21 to alignment with the next, then to the next and so on so that a rotating jet of water 24, 24', 24" etc. is ejected from head 10, sweeping the pool surface 11 surrounding the head and stirring up sediment from the pool surface.

The prior art turbo jet is thus shown to serve its intended purpose with the one drawback, namely its tendency for interference with other cleaning systems. The present invention corrects this deficiency by altering the external contours of the dispensing head 10.

Figure 2:
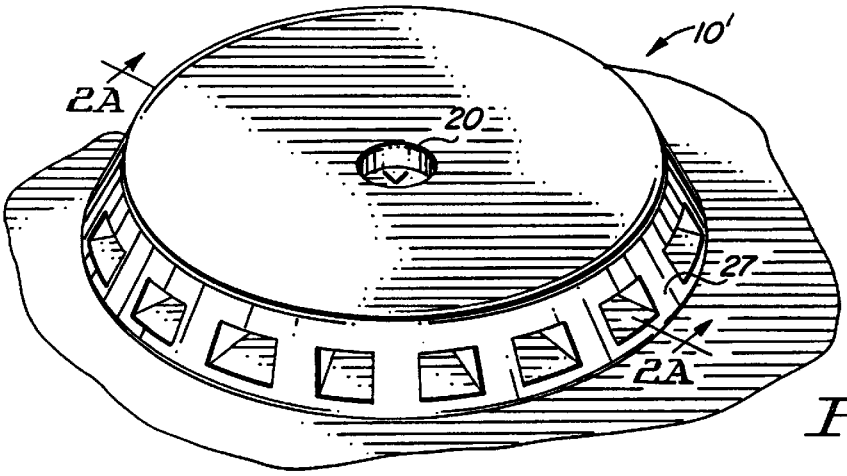
FIG. 2 is a perspective view of a modified turbo jet dispensing head in accordance with the improved external contours provided by the present invention.
Figure 2A:
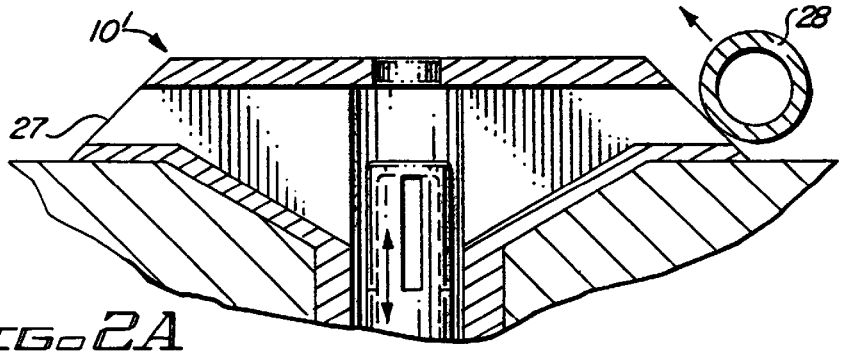
FIG. 2A is a cross-sectional view of FIG. 2 taken along line 2A—2A of FIG. 2.

FIGS. 2 and 2A show a modified dispensing head 10' with altered external contours in accordance with the objects of the present invention. Comparing the modified head 10' of FIGS. 2 and 2A with the prior art head 10 of FIGS. 1 and 1A, it is seen that head 10' is the same as head 10 except that the cylindrical edges 26 of head 10 have been replaced by the conical surface 27 of head 10' which serve as a ramp over which an external object such as a hose or whip 28 of another cleaning system may readily ride without becoming trapped or diverted from its intended route of travel.

While the modified contours of head 10' represent a satisfactory solution of the entrapment problem for new-build dispensing heads, there are numerous dispensing heads of the prior art version already installed in swimming pools. For such units, a convenient means for retrofit is needed.

Figure 3:
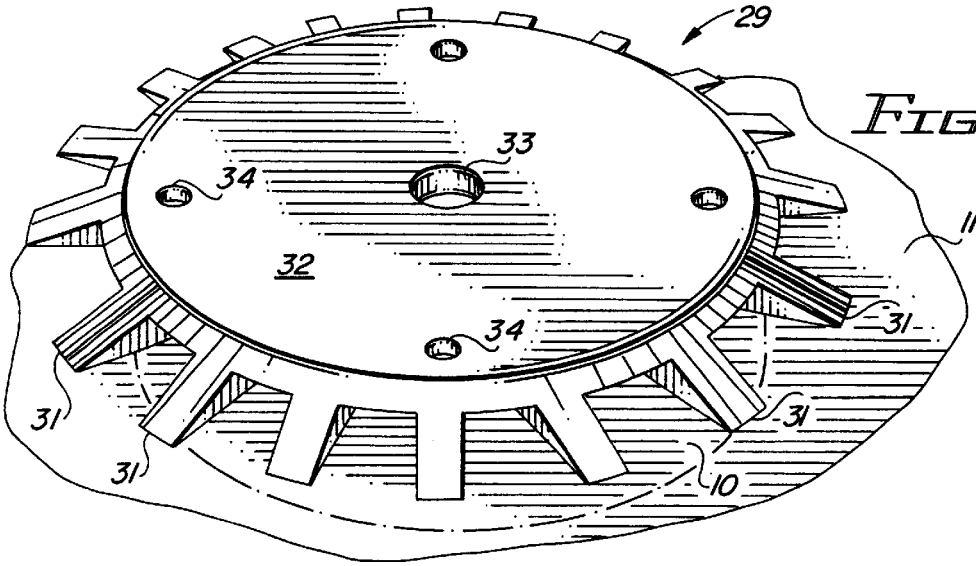
FIG. 3 is a perspective view of a cap or cover that may be installed over an existing turbo jet dispensing head and secured in place thereon by means of screws in accordance with the present invention.

FIG. 3 illustrates a first embodiment of a cap or cover 29 that can be mounted over the top of the prior art dispensing head 10 of FIGS. 1 and 2.

As shown in FIG. 3, the cap 29 fits over the dispensing head 10 like a bottle cap. Arranged about the circumference of the cap 29 are radially oriented, uniformly spaced fingers 31, each aligned with one of the wedge-shaped outer portions 19 of the fins 16 of head 10. The fingers 31 form ramps extending from the pool surface 11 to the top surface 32 of the cap 29 so that, as in the case of the modified head 10' of FIGS. 2 and 2A, other cleaning equipment such as hoses and whips readily move over the head 10 and its cap 29.

The cap 29 has a centered opening 33 aligned with observation hole 20 of head 10 to allow continued visual access to the pop-up valve 22.

The cap 29 is secured to head 10 using an adhesive such as epoxy or by means of screws that pass through screw holes 34 in cap 29 and thread into holes (not shown) that are drilled into the top of head 10 at the time the cap 29 is installed.

The cap or cover 29 can readily be installed over an existing turbo jet dispensing head 10, but the installation can only occur after the pool has been drained (in order to apply the adhesive or to drill the holes and install the screws).

Figure 4:
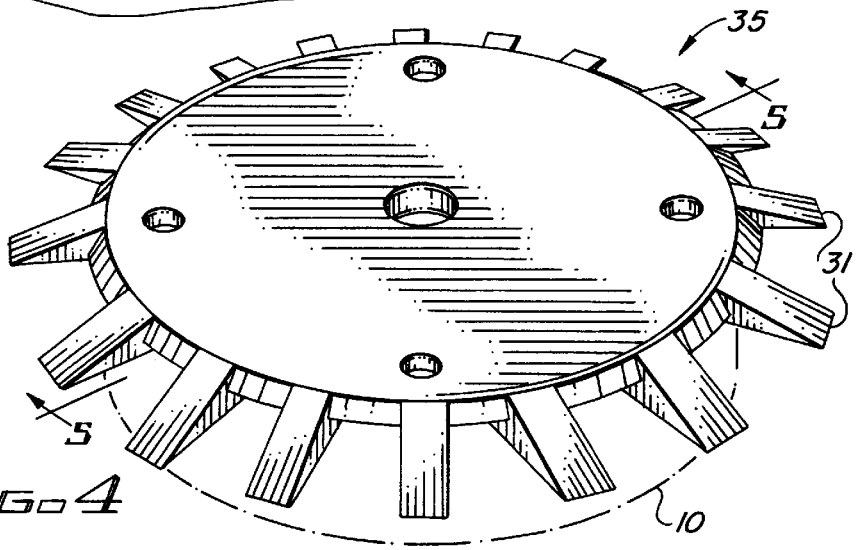
FIG. 4 is a perspective view of another embodiment of the present invention in the form of a snap-on cap or cover for a turbo jet dispensing head.
Figure 5:
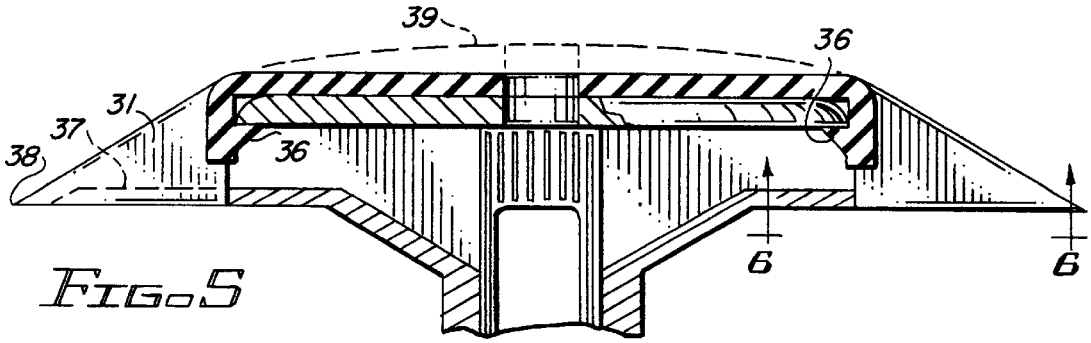
FIG. 5 is a cross-sectional view of FIG. 4 taken along line 5—5 of FIG. 4.
Figure 6:
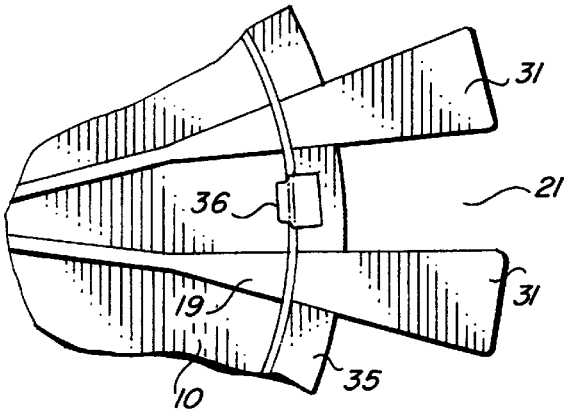
FIG. 6 shows the under side of the cover of FIG. 5 as seen along line 6—6 of FIG. 5.

Another embodiment of the invention which can be installed without draining the pool comprises a snap-on cap or cover 35 as shown in FIGS. 4, 5 and 6.

The cover 35 is the same as cover 29 of FIG. 3 except that cover 35 is secured to head 10 by means of two or more snap-action grips 36 uniformly spaced about the circumference of the cover 35 as shown in FIGS. 5 and 6. As shown most clearly in FIG. 5, the grip 36 has a ramped underside that rides over the outer surface of the head 10 as the cover 35 is pressed down over the head 10. The grips then snap into their retaining positions. As shown in FIG. 6, each grip 36 is aligned with a channel 21 of head 10.

Optional design variations applicable to cover 29 as well as to cover 35 are shown in FIG. 5.

To insure that the outer tips of the fingers will bear against the wall of the pool, the resilient fingers may be undercut as indicated by broken line 37. With appropriate dimensioning of the fingers 31, the resilience of the plastic fingers will accommodate thickness tolerances of the head 10 while assuring contact of the finger tips 38 with the pool surface for both covers, 29 and 35, and assuring adequate travel to complete the snapping action of grips 36 in the case of cover 35.

Additionally, the top surface of the cover 29 as well as that of cover 35 may be somewhat rounded or dome-shaped as shown by broken line 39 in FIG. 5.

Figure 7:
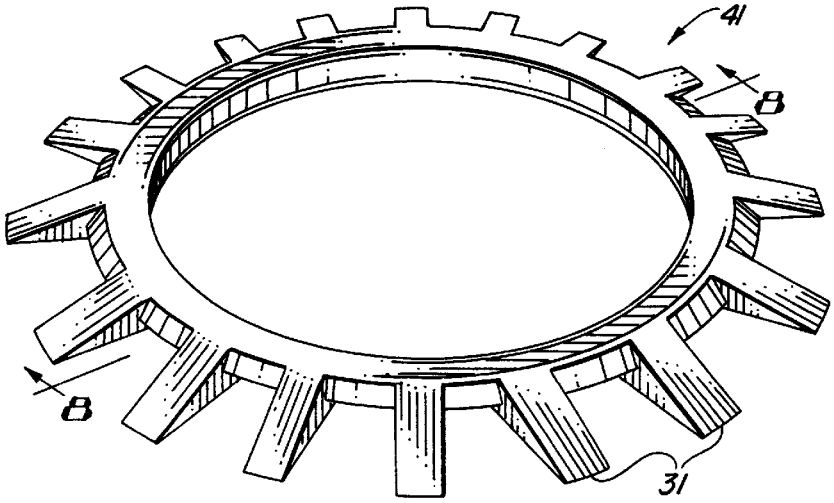
FIG. 7 is a perspective view of yet another embodiment of the invention in the form of a snap-on ring that may be employed as a cover for a turbo jet dispensing head.
Figure 8:
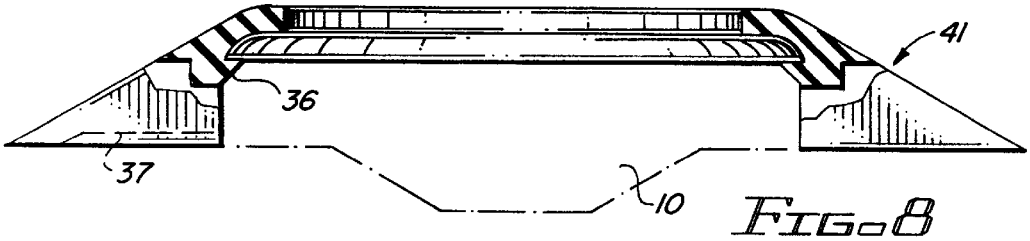
FIG. 8 is a cross-sectional view of FIG. 7 taken along line 8—8 of FIG. 7.
Figure 9:
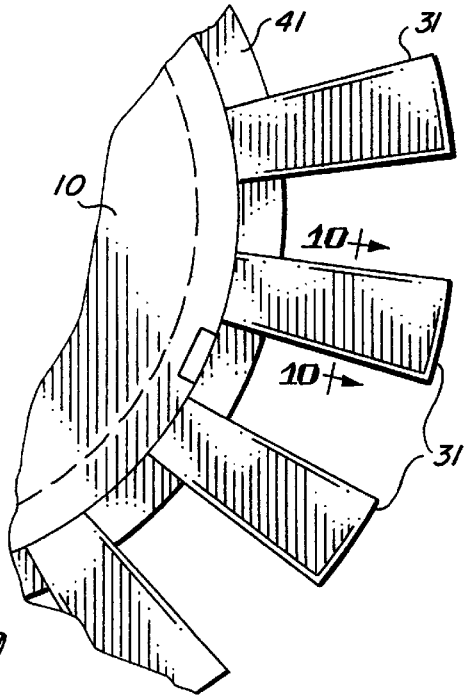
FIG. 9 is a partial bottom view of FIG. 8.

Yet another embodiment of the invention is shown in FIGS. 7, 8 and 9 in the form of a snap-on ring cover 41. The ring cover 41 has all of the features of the snap-on cover 35 of FIGS. 4, 5 and 6 except that the center of the cover has been cut away to reduce the material content of the protective cover.

Figure 10:
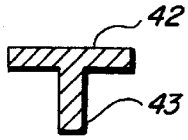
FIG. 10 is a cross-sectional view taken along line 10—10 of FIG. 9 showing an optional construction for the protective covers of the invention.

An additional variation in the interest of reduced material cost applicable to covers 29, 35 and 41 is shown in FIG. 10. As shown in FIG. 10, the fingers 31 may have a reduced cross-sectional area in a T-shaped configuration with an outer plate or ramp 42 and a longitudinal rib 43 on the underside for strength.

Although but a few embodiments of the invention have been illustrated and described, it will be apparent to those skilled in the art that various changes and modifications may be made therein without departing from the spirit of the invention or from the scope of the appended claims.

What is claimed is:

1. A cover for a turbo jet dispensing head of a turbo jet swimming pool cleaning device said cover comprising:

a circular top having a plurality of integral, radially outwardly extending fingers uniformly spaced about its periphery;

said cover fitting over and around said dispensing head with each of said integral fingers aligned with a corresponding vane of said dispensing head;

each of said fingers comprising a ramp extending from the surface of the swimming pool wall to the top of said cover;

means for securing said cover in place upon said dispensing head; and an opening at the center of said circular top aligned with a viewing hole in the top of said dispensing head as a means for observing the operation of said turbo jet dispensing head;

whereby said cover serves as a ramp over which other swimming pool equipment can readily move without interference from the dispensing head.

2. The cover set forth in claim 1 wherein said means for securing said cover comprises screws passing through said top of said cover and adapted to thread onto the top of said dispensing head.

3. The cover set forth in claim 1 wherein said means for securing said cover to said dispensing head comprises at least two snap-action grips integrally incorporated in said cover.

4. The cover set forth in claim 1 wherein the center of said cover is open, leaving a ring shaped top.

5. The cover set forth in claim 1 wherein said circular top has a conically shaped outer surface so as to avoid interfering with other swimming pool cleaning equipment.

* * * * *